US006244310B1

(12) United States Patent
Rowland et al.

(10) Patent No.: US 6,244,310 B1
(45) Date of Patent: Jun. 12, 2001

(54) VAPOR RECOVERY DIAGNOSTIC TESTING SYSTEM

(75) Inventors: Steven L. Rowland, Greensboro; Hal C. Hartsell, Jr., Kernersville, both of NC (US)

(73) Assignee: Marconi Commerce Systems Inc., Greensboro, NC (US)

( * ) Notice: Subject to any disclaimer, the term of this patent is extended or adjusted under 35 U.S.C. 154(b) by 0 days.

(21) Appl. No.: 09/589,245

(22) Filed: Jun. 7, 2000

Related U.S. Application Data

(63) Continuation of application No. 09/432,987, filed on Nov. 3, 1999, now Pat. No. 6,082,415, which is a continuation of application No. 09/140,128, filed on Aug. 25, 1998, now abandoned.

(51) Int. Cl.[7] ..... B65B 31/00

(52) U.S. Cl. ..... 141/59; 141/83; 141/44; 141/45; 73/1.35; 73/1.36

(58) Field of Search ..... 141/59, 44, 45, 141/94, 95, 96, 206, 209, 83, 290, 302, 392; 73/1.25, 1.26, 1.34, 1.35, 1.36, 1.49, 49.1, 49.5, 49.7

(56) References Cited

U.S. PATENT DOCUMENTS 4,072,934 * 2/1978 Hiller et al. ..... 141/59
5,040,577 * 8/1991 Pope ..... 141/59
5,220,822 * 6/1993 Tuma .
5,269,353 * 12/1993 Nanaji ..... 141/59
5,316,057 * 5/1994 Hasselmann ..... 141/94
5,450,883 * 9/1995 Payne et al. ..... 141/59
5,592,979 * 1/1997 Payne et al. ..... 141/59
5,673,732 * 10/1997 Kenney et al. ..... 141/59
5,715,875 * 2/1998 Clary et al. ..... 141/59
5,765,603 * 6/1998 Healy ..... 141/59
5,779,097 * 7/1998 Olson et al. ..... 141/59

FOREIGN PATENT DOCUMENTS

0653376 * 5/1995 (EP) .

* cited by examiner

*Primary Examiner*—Steven O. Douglas
*Assistant Examiner*—Khoa D. Huynh
(74) *Attorney, Agent, or Firm*—Withrow & Terranova PLLC

(57) ABSTRACT

A system for monitoring and testing the operation of a vapor recovery system within a fuel dispensing device. The system utilizes strategically placed sensors within the fuel dispensing device to gather data pertaining to each pump and hose combination for that fuel dispensing device. The gathered data is forwarded to an internal digital controller processing device where calculations are performed and results are compared to baseline results stored in memory within the digital controller. Anomalous results are displayed and/or printed. The system operates in both automatic and manual diagnostic modes. The automatic diagnostic mode runs continuously without interfering with the normal operation of the fuel dispensing device.

27 Claims, 1 Drawing Sheet

VAPOR RECOVERY DIAGNOSTIC TESTING SYSTEM

This application is a con't of Ser. No. 09/432,987 filed Nov. 3, 1999, U.S. Pat. No. 6,082,415 which is a con't Ser. No. 09/140,128 filed Aug. 25, 1998, abnd.

TECHNICAL FIELD

The present invention relates to the testing and monitoring of vapor recovery systems within fuel dispensing devices. More particularly, the present invention relates to automatic diagnostic testing and monitoring of vapor recovery systems within fuel dispensing devices.

BACKGROUND ART

Vapor recovery systems for fuel dispensing devices have been the subject of previous patents. The subject of monitoring or testing such vapor recovery systems, however, is not as well developed. The following references illustrate the general state-of-the-art pertaining to vapor recovery system testing.

U.S. Pat. No. 5,715,875 to Clary et al. describes a method and apparatus for dry testing vapor recovery systems. The apparatus is essentially a valve having two mechanisms for opening the valve. The first mechanism opens the valve when fuel is being dispensed while the second valve selectively opens the valve without regard to whether the system is dispensing fuel. The focus of Clary et al. is on the physical structure of the valve which allows for "dry testing" of the vapor recovery system by simulating the rate of fuel that would be dispensed without actually having to dispense any fuel and comparing vapor recovery path measurements against the simulated rate in order to determine the effectiveness of the vapor recovery system. Clary et al. appears to be limited to testing vapor recovery rates in general and purports to be able to identify when vapor recovery rates are inadequate. However, Clary et al. does not suggest specific reasons for insufficient rates.

U.S. Pat No. 5,316,057 to Hasselmann describes a vapor recovery system tester. This invention comprises an external ring-like apparatus adapted to fit around and seal to a fuel dispensing spout having vapor recovery apertures. The ring-like apparatus, in turn has a tube connecting it to a air volume measuring instrument which measures the volume of air recovered via the vapor apertures. The recovered volume is then compared to the volume of fuel dispensed to yield an indication of vapor recovery efficiency. Hasselmann is an external device not an internal device. It appears to be directed solely at determining V/L ratios (volume of vapors recovered to the volume of fuel dispensed).

U.S. Pat. No. 5,220,822 to Tuma describes a method for testing vapor recovery lines. Tuma describes a testing method for determining both the integrity and blockage of a vapor recovery system. Tuma requires modifying the vapor recovery unit for vacuum testing. System integrity is tested by drawing a vacuum into the unit to a predetermined level then monitoring it for decay over time in order to determine whether and how severely the system is leaking. System blockage is tested by continuously drawing a vacuum into the unit while the lines are disconnected from the dispensing station at the point most closest to the station. Flow of fluid induced by the vacuum is measured and compared to desired flow rates in order to determine the extent the line is blocked, if at all.

U.S. Pat. No. 4,392,870 to Chieffo et al. describes a vapor recovery unit performance test analyzer and method for use specifically in systems utilizing first and second parallel charcoal beds acting as adsorbing units. In such charcoal bed systems one bed acts to adsorb hydrocarbon vapors while the other is regenerated by vacuum . Once a certain level of adsorption is reached the beds must be switched so that the regenerated bed is now the adsorbing bed and vice-versa. Chieffo et al. describes an electronic monitoring means for both beds utilizing temperature sensors, flowmeters, flow amplifiers, and an electronic unit for obtaining and processing sensed data representing the total hydrocarbon flow of the system. Chieffo et al. appears limited to the parallel charcoal bed configuration described above.

EPO Publication No. EP 0 653 376 A1 to Finlayson describes a vapor recovery system for fuel dispensers. Finlayson is couched in terms of an improved vapor recovery system rather than a tester of vapor recovery systems. It discloses a controller which receives from various sensors signals representative of the fuel vapor/air ratio immediately outside the tank, inside the tank, and/or inside the vapor recovery conduit, and/or the pressure relative to atmosphere inside the tank and/or of the rate of flow of liquid being dispensed. Based on these input signals, the controller operates the vacuum pump at an optimal rate to collect fuel vapor displaced from the tank. Finlayson permits the sensors to be located on the dispensing apparatus itself thereby obviating the need for special sensors and connections in or on the receptacle tank.

U.S. Pat No. 5,450,883 to Payne et al. and U.S. Pat. No. 5,040,577 to Pope, issued to the assignee of the present invention, disclose systems and methods for testing for error conditions in a fuel vapor recover illustrating the general state of the art.

None of the aforementioned references teaches an all encompassing internal diagnostic monitoring and testing system like that of the present invention.

DISCLOSURE OF THE INVENTION

The present invention concerns an automatic diagnostic testing system and/or device for vapor recovery systems operating within fuel dispensing systems. Specifically, several potential problems that may occur within a fuel dispensing system utilizing vapor recovery are identified and non-invasive diagnostic tests are capable of being performed for several potential problems. Problems include fuel in the vapor line, inoperable vapor valves, presence of hazardous conditions, vapor leaks, pressure drops, mis-calibrated pumps, unsatisfactory flow rates, and others. The present invention is capable of continuously monitoring the vapor recovery system during normal operation. Some of the particular features of the present invention include the ability to initialize system parameters subsequent to a baseline test of the system, dual mode operation (automatic and manual), and keypad and/or cardreader access to the diagnostic testing data with video display and print capabilities.

Therefore, it is an object of the invention to provide a system that is internal to a fuel dispensing device having a vapor recovery system that is capable of monitoring and diagnostic testing the vapor recovery system within the fuel dispensing device for the purpose of discovering anomalies therein.

It is a further object of the invention to have the diagnostic testing equipment automatically and continuously running during normal operation of the fuel dispensing device.

It is a still further object of the invention to provide a set of manual diagnostic tests that are minimally invasive to the fuel dispensing device which are run upon detection of an anomaly by the automatic diagnostic testing portion of the invention.

Some of the objects of the invention having been stated hereinabove, other objects will become evident as the description proceeds, when taken in connection with the accompanying drawings as best described hereinbelow.

BEST MODE FOR CARRYING OUT THE INVENTION

Figure 1:
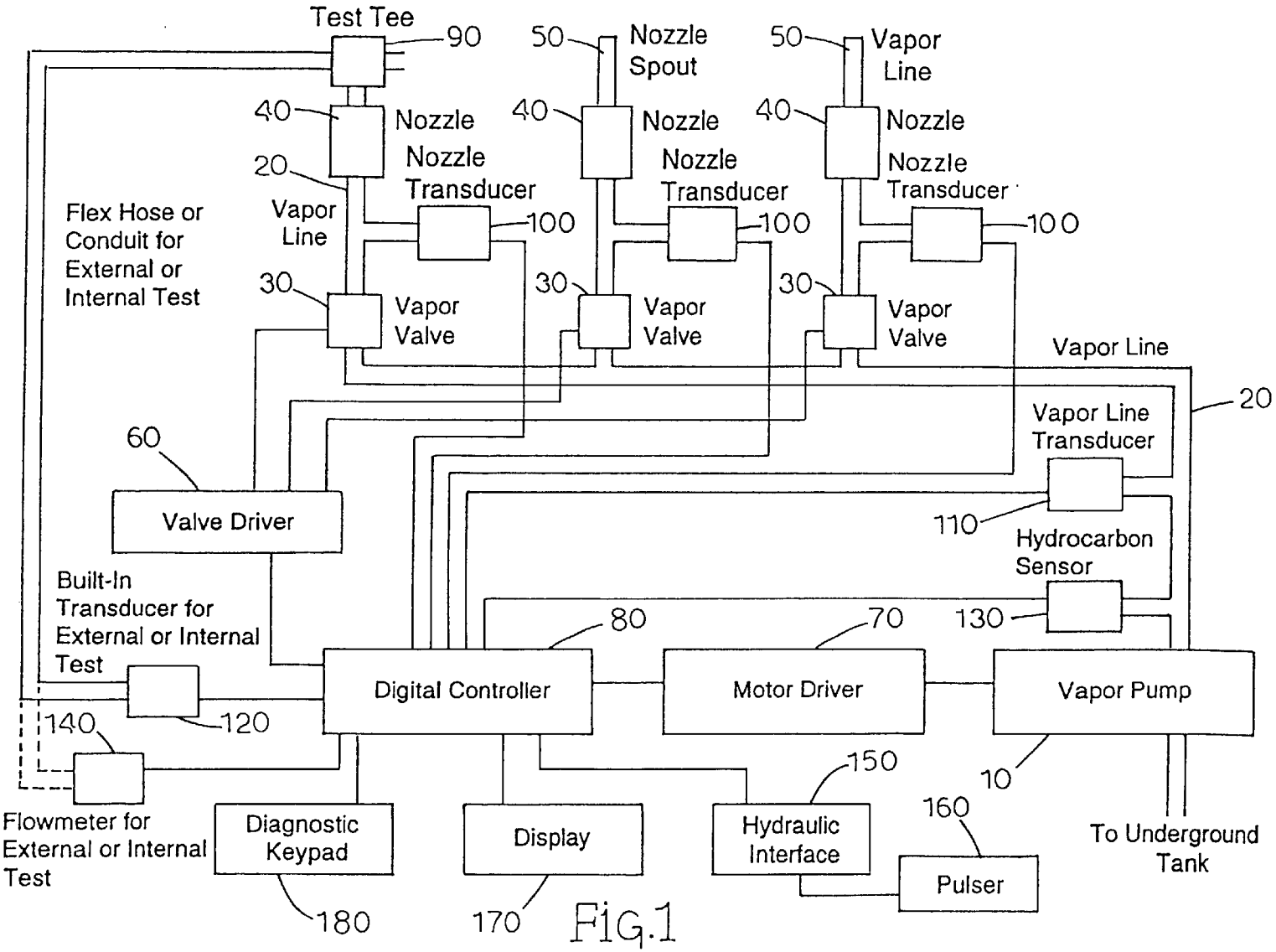
FIG. 1 is a schematic illustration of the components that comprise the diagnostic test system of the present invention.

The vapor recovery diagnostic system of the present invention monitors both the condition of certain actual physical elements involved in vapor recovery from a fuel dispensing device such as a gasoline pump, and also vapor recovery system operating conditions in general. Some of the former include, for instance, inoperable vapor valves and kinked or blocked hanging hardware hoses as indicated by unusual pressure drops over the length of such hoses. Some of the latter include, for instance, fuel in the vapor line, unacceptable flow-rates, mis-calibrated vapor pumps, and vapor leaks.

FIG. 1 illustrates a block diagram setting out the elements of a vapor recovery system within a fuel dispensing device. FIG. 1 further includes the elements that perform the diagnostic monitoring and testing of the vapor recovery system. It is the diagnostic monitoring of a fuel vapor recovery system that makes up the novel subject matter of the present application.

The elements that comprise the vapor recovery portion of FIG. 1 include a vapor pump 10, vapor lines 20, vapor valves 30, fuel dispensing nozzles 40, fuel dispensing nozzle spouts 50, vapor valve driver 60, motor driver 70, and digital controller 80.

The elements that comprise the diagnostic monitoring portion of the vapor recovery system include, test tee 90, individual nozzle transducers 100, vapor line transducer 110, built-in transducer 120, hydrocarbon sensor 130, flow-meter 140, digital controller 80, motor driver 70, vapor pump 10, hydraulic interface 150, pulser 160, display 170, and diagnostic keypad 180.

The remaining elements are necessary to perform the actual dispensing of fuel as well as record and electronically process the transaction. These elements include the hanging hardware (not shown), diagnostic keypad 180, display 170, hydraulic interface 150, digital controller 80, and pulser 160.

Certain elements have been identified as being a part of more than one of the above described three categories because such elements have been modified to perform functions for more than one of the above systems.

The essential function of a fuel dispensing system is, of course, dispensing fuel. To that end, fuel is drawn from an underground tank (not shown) and pumped into and through the hanging hardware to the nozzle and spout into a receiving tank such as in an automobile. Driving and controlling this process is a motor driver 70 which creates the required vacuum pressure to draw the fuel from the underground tank to the automobile tank, a pulser 160 and hydraulic interface 150 for monitoring and gauging the amount of fuel dispensed, a digital controller 80 for translating the amount of fuel into the cost of the fuel, a display 170 for outputting the amount of fuel and cost of fuel data to the consumer, and a diagnostic keypad 180 for accepting consumer input relating to the transaction.

The above described system has been improved by adding hardware that recovers the vapors present in an automobile's gas tank that are displaced during the re-filling of the gas tank. These so-called Vapor Recovery Systems are the result of environmental concerns and governmental regulations. Vapor recovery essentially employs a motor driven vapor pump 10 which creates a vacuum for sucking fumes from the area where a fuel dispensing nozzle, (which has apertures for passing vapors from the automobile gas tank to the vapor recovery system), meets an automobile's gas tank opening and through vapor lines 20 which are typically contained within the hanging hardware (not shown) and through vapor valve 30 and ultimately back into the underground storage tank (not shown).

It is primarily due to certain U. S. governmental regulations that a need has developed for an efficient and accurate system and/or method of monitoring the performance of the Vapor Recovery Systems to ensure that they are functioning within the limits set by law. The present invention addresses this need through the addition of certain physical sensor elements which are under the control of the digital controller 80. These sensors are able to determine several key conditions which when processed give an indication of the Vapor Recovery System's current condition. Moreover, many of these tests are automatic in nature and are continuously running in a background mode without impairing the use or normal operation of the fuel dispensing device. Some of the tests require the pump to be taken off-line in the sense that the pump being tested cannot simultaneously be servicing a consumer. All of the tests have been designed to be minimally invasive to the fuel dispensing unit as a whole. Moreover, the results of all the various tests are logged within the digital controller 80 for later off-line analysis Certain conditions when present, however, may require more immediate action rather than simply recording the results for later analysis. In such cases, and depending on the condition present, affirmative action can be taken by an attendant or the pump can even shut itself down if the situation warrants such action. The tests capable of being performed by the present invention are described in further detail hereinbelow.

SYSTEM INITIALIZATION

The first step in the vapor recovery diagnostic system is to program the digital controller 80 with the tolerable minimum and maximum operating parameters for the flow-rate, pressure drops across the hanging hardware, deadhead vacuum, and A/L ratio for each of the pumps within the fuel dispensing device. This information is obtained from the dispenser manufacturer and local regulatory agency. It is a combination of regulatory performance specifications and engineering data developed by the manufacturer. The various parameters are then input into memory within the digital controller 80 for subsequent comparative purposes.

BASELINE PROGRAMMING

The present invention requires each pump on a fuel dispensing device to be subjected to a series of baseline tests performed at the time of installation. The results of these baseline tests are then recorded and placed into the memory of digital controller 80. Future tests are then compared to the baseline profile for that particular pump/hose combination in order to determine changes in that pump/hose's operating condition. The baseline tests are now described.

Following system initialization programming of the tolerable minimum and maximum operating parameters for the flow-rate, pressure drops across the hanging hardware, deadhead vacuum, and A/L ratio, several commissioning tests would be performed by a system technician at the time of installation of the fuel dispensing device. Since these tests are performed by a system technician at the time of installation, a security code is used in order to give the technician access to certain functions of the fuel dispensing device. This is to ensure the integrity of the initialization data used for comparative purposes by later tests. The security code can be a PIN code the technician inputs via diagnostic keypad 180 which is processed by digital controller 80 for verification. Upon verification, the technician is given unlimited access to the pump device for the purpose of preforming the commissioning tests. Display 170 then lists the available options to the technician. The technician utilizes diagnostic keypad 180 to invoke the tests which are stored on digital controller 80 and can be listed in a menu fashion on display 170. Results are output on display 170 and stored in memory when appropriate. There are four (4) such commissioning tests which are performed in a specific order. The purpose of the commissioning tests is to establish the various operating parameters for each individual pump/hose combination (i.e., nozzle assembly) to be used by subsequent diagnostic tests. A pump/hose combination essentially comprises nozzle 40 and spout 50, the hose (hanging hardware) connecting the nozzle assembly to the fuel dispensing device, and the internal lines leading to the underground storage tank. There may be multiple pump/hose combinations per fuel dispensing device. The commissioning tests are required at installation or after a master reset of the fuel dispensing device.

The first commissioning test can be termed the pulse simulator calibration test. The test is designed to establish a beginning actual flow-rate for each pump/hose combination within the fuel dispensing device. The results of the test are stored within the memory of digital controller 80 and serve to establish a reference point for a pulse simulation. Pulse simulation mirrors the actual flow-rates of the pumps in question for subsequent tests which require such a measurement or simulation. To perform the test, the technician actually dispenses fuel from each pump/hose combination within the fuel dispensing device. Upon selecting this test mode, the technician dispenses fuel from each hose after activating the pump handle and opening the nozzle for maximum flow. After the flow rate becomes stable , the digital controller 80 automatically logs the flow rate and displays same on the display for the corresponding grade of fuel or hose. After each of the hoses and fuel grades are tested the technician exits the test. The digital controller 80 then compares these measurements to the tolerable limits established by the system initialization parameters. If the measured flow-rate are acceptable then they are saved into the digital controller's 80 memory for that particular hose/fuel grade of that particular fuel dispensing device. This value now becomes the reference or baseline value used by subsequent tests on this particular pump which require comparison or calculation involving this pump/hose combination's baseline flow-rate. If, however, the measured flow-rate falls outside of the tolerable parameters set during system initialization for four subsequent transactions, then a warning message would be displayed at the pump and/or inside at the point-of-sale device (e.g., cash register) signaling the store manager the flowrate is out of compliance.

The second commissioning test can be termed the transducer test. The test is designed to ensure that the nozzle transducers 100, vapor line transducer 110, external transducer 120, and hydrocarbon sensor 130 are all active and operating. The transducers are the sensor elements that actually record certain physical measurements within the vapor recovery system and pass the results to the digital controller 80 for processing. The transducer test is essentially a roll call in which the digital controller 80 sends each transducer a specific code and each transducer must return a specific acknowledgment code to the digital controller 80 thereby demonstrating that the transducer in question is on-line and functioning. The technician uses the diagnostic keypad 180 to initiate the procedure via a menu system, or the like. Results of the test are logged into memory and transducer failures are brought to the technician's attention via display 170. Failing transducers 100 are then replaced by the technician.

The third commissioning test can be termed the baseline pressure drop test. This test is designed to establish a baseline reading for detecting sudden and continuous pressure drops (or changes) during future transactions. Sudden pressure drops are indicative of, inter alia, fuel in the vapor line 20 or a permanently kinked, broken, or open vapor line 20. The technician selects a particular pump/hose combination to be tested. While running the vapor pump 10, the technician logs the pressure drop across the hanging hardware as indicated by its associated transducer. The pressure drop in the vapor return line of each hose is determined by taking the difference in pressure readings between each of the respective nozzle transducers 100 and built-in transducer 120. Each pump/hose combination's baseline pressure drop results are stored in memory within digital controller 80 for later comparative uses. If the baseline pressure readings are outside the tolerable limits set at system installation, then the hose is placed out of order by the manager thereby necessitating a service call to a technician. The baseline pressure drop test must be re-run whenever new hanging hardware is installed.

The fourth commissioning test can be termed the vapor pump speed calibration test. This test is designed to calibrate each vapor pump/hose combination's speed or flow-rate to achieve a pre-determined AIL ratio, such as, for instance, 1.1. The AIL ratio stands for air to liquid ratio and is the ratio of the volume of air ingested by the vapor recovery nozzle to the volume of fuel dispensed by the nozzle. The A/L ratio is an index of performance and is significant because it correlates with the vapor recovery efficiency of the vapor recovery system. Vapors are typically recovered at a rate sufficient to capture at least 95% of those emitted from the vehicle. The A/L ratio is, therefore, a performance specification of the vapor recovery system which must be adhered to in order to permit operation of the dispenser. This test can be performed in one of two ways. The first method requires the technician to place nozzle spout 50 into test tee 90. Vapor pump 10 is then activated for the purpose of gathering samples of air volume per sample of simulated gallons. Digital controller 80 then sets the pump speed to achieve the pre-determined A/L ratio. The digital controller 80 compares the ingested volume of air against the simulated volume of dispensed fuel and makes the necessary adjustments to obtain the pre-determined A/L ratio. The pump speed necessary to achieve the pre-determined A/L ratio is then stored within digital controller 80. This method allows each hose to be calibrated instead of the pump as a whole. The significance of this feature is that it allows a fuel dispensing device to use hoses from various manufacturers which are likely to have differing pressure drops. This is possible because each hose can be calibrated separately.

The second method allows the technician to utilize built-in transducer 120 for calibrating the hose rather than the built-in flow-meter 140. Under this scheme, the digital controller automatically adjusts the pump speed based on the built-in transducer 120 vacuum reading to achieve the desired pre-determined A/L ratio as opposed to using the flow-meter 140. The pump speed is adjusted by the digital controller 80 to obtain the requisite vacuum for that particular simulated flow-rate. Again, the pump speed necessary to achieve the pre-determined A/L ratio is then stored within digital controller 80. Both methods yield the same result, namely, a pump speed calibration set at the desired pre-determined A/L ratio. The invention can be calibrated to other pre-determined A/L ratios.

pump speed can be calibrated to achieve pre-determined A/L ratios at discrete intervals over a plurality of fuel dispensing rates ranging between a lower fuel dispensing rate limit and an upper fuel dispensing rate limit. The discrete intervals between the lower fuel dispensing rate limit and an upper fuel dispensing rate limit can be both manually set and/or automatically set by the digital controller 80.

Once the commissioning tests have been performed and the necessary baseline readings for each individual pump/hose combination for a particular fuel dispensing device have been written into memory within digital controller 80, the fuel dispensing device is ready to be placed on-line for consumer use. During consumer use digital controller 80 continuously monitors the individual pumps and hoses that comprise the vapor recovery system for the fuel dispensing device. This self-monitoring is achieved through the automatic diagnostic test mode of the present invention and is able to monitor several conditions. In addition to the automatic diagnostic mode, the present invention also possesses a manual diagnostic mode which allows a properly trained or authorized person, usually a technician, owner, manager, or inspector of the fuel dispensing device to perform specific tests to evaluate the operating conditions of the vapor recovery system. The manual diagnostic tests do not require a security code or special access to the fuel dispensing device. Most of the manual tests do not even require that the fuel dispensing device be taken off-line. A manual test may be warranted when a certain condition is detected by one or more of the automatic diagnostic tests. Both the automatic diagnostic test mode and the manual diagnostic test mode are now described in greater detail.

The automatic diagnostic test mode continuously monitors operation of the vapor recovery system during normal operation. The tests performed are designed to detect several conditions that indicate the level of performance of the vapor recovery system. Such conditions include: detecting flow-rates outside of the tolerable limits set at installation which are typically between six (6) and ten (10) gallons per minute (GPM); topoffs resulting in fuel entering the vapor line 20; pressure increases occurring on back-to-back transactions across hanging hardware indicating a kinked or otherwise damaged or changed hose; failure or disconnection of any of the internal transducers; pressure drops across a clogged or partially closed vapor valve 30; and a significant drop in deadhead vacuum pressure indicating the possibility of worn or broken vapor pump vanes or leaks in internal vapor return line piping.

In monitoring flow-rates of each pump/hose combination, digital controller 80 continuously checks to ensure that the flow-rate is within tolerable limits by comparing the actual flow-rate during a transaction to the stored baseline limits set at installation.

Topping off a fuel tank may cause fuel to enter vapor line 20. If fuel does enter the vapor line 20 of the vapor recovery system, then there would be a detectable sudden rise in vacuum pressure in conjunction with the multiple nozzle clicks associated with topping of a tank. If such a sudden rise in the vacuum pressure is detected by the system transducers, then vapor pump 10 is cycled in order to clear the fuel from vapor line 20 prior to the next transaction. Digital controller 80 automatically cycles the pump for a period of time to remove the slug of fuel from the vapor return line, usually after the transaction has ended.

A pressure increase detected by a vapor line transducer 110 on back-to-back transactions across the associated hanging hardware may indicate that the hose is kinked, or that the original hose was replaced with another hose having an inherently higher pressure drop. Such a condition constitutes a hard failure which would necessitate a service call to an authorized technician. Digital controller 80 buffers the four most recent transactions in order to provide a reasonable comparison baseline. As a matter of design choice, more or less than the four most recent transactions may be used in the implementation of the present invention. Moreover, after having detected such a condition for whatever reason, digital controller 80 would also require that a particular pump/hose combination be recalibrated prior to placing that pump/hose back on-line. Re-calibration comprises performing the baseline pressure drop test described in the commissioning tests above.

Digital controller 80 also continuously monitors the status of the various pressure transducers used by the diagnostic system to detect and gather the pertinent data used for other tests. It is essential that these elements be maintained in good working order for the rest of the system to function properly. Thus, a test similar to the transducer test described earlier is periodically performed to verify that all of the transducers are functional and running by continuously reading the electric current and/or voltage from the transducers (100, 110, 120).

Each vapor valve 30 is continuously monitored for partial or total clogs as indicated by unusual pressure drops across the valves. The pressure drops are sensed by the comparing the pressure reading of nozzle transducer 100 on one side of vapor valve 30 to the pressure reading of vapor line transducer 110 located on the other side of vapor valve 30. The difference between the upstream pressure reading and the downstream pressure reading indicates whether vapor valve 30 is open, partially clogged, or totally blocked. The resulting difference in the pressure readings is logged in memory within digital controller 80 for off-line analysis. If the result indicates a partial or total blockage of vapor valve 30, then an alert is displayed to the pump proprietor on his console so that appropriate remedial action can be taken.

The deadhead vacuum pressure is also monitored by the system of the invention. Deadhead vacuum pressure refers to the maximum vacuum created while blocking air flow on the vacuum side of the pump. Deadhead vacuum pressure is monitored by vapor line transducer 110 while all vapor valves 30 are closed. The results of the test are then stored in the memory of digital controller 80. The results of this test indicate whether the pump can pull a vacuum. If the vanes in the pump are broken or worm, the pump will not fall within the operating parameters determined at commissioning. This constitutes a hard failure requiring a service call to an authorized technician.

The present invention also comprises a set of manual diagnostic tests that are performed by an authorized technician upon a service call due to anomalous readings given by an automatic diagnostic test or tests. There are several manual diagnostic tests the technician may run. They include: line flush test; internal A/L test (flow-meter and/or vacuum); external A/L test (flow-meter and/or vacuum);

pressure drop test; pressure decay test; and/or vapor valve/deadhead vacuum test. The technician gains access to the manual diagnostic mode via fuel dispenser keypad 180 and/or the card reader. During performance of the various tests, results are displayed on the fuel dispenser display 170 and can also be printed through the fuel dispenser receipt printer (not shown) or at the main console. Upon access to the diagnostic mode the technician is presented with a list of manual diagnostic tests. The technician can select any of the listed tests without regard to a specific order. Each of the manual tests is described in greater detail below.

The line flush test is performed if the technician suspects the presence of fuel in vapor line 20 for a particular pump/hose combination. The test essentially comprises turning vapor pump 10 on for a short period of time to flush any slug of fuel out of vapor line 20. A pressure reading is taken from that pump's nozzle transducer 100 prior to the flush and just after the flush. The vapor pump 10 is run again. The process is repeated until the pressure drop reading after each flush reaches a steady state. The number of flushes needed to reach a steady state is logged for off-line analysis. The pressure readings are compared to the baseline profile for that pump/hose combination in order to determine the effectiveness of the test. A technician would also perform this test prior to performing an A/L ratio test.

The internal A/L test measures the air to liquid ratio of a particular pump/hose combination. This test can be performed in one of two ways. Option one (1) entails using flow-meter 140. The technician places a pump/hose combination's nozzle 40 and spout 50 into a test tee 90 that is built-in to the fuel dispensing device itself. Without dispensing fuel, digital controller 80 runs the vapor pump 10 mirroring the flow-rate for that pump/hose combination. The flow-rate was previously determined and stored during installation and commissioning of the fuel dispensing device. While running the vapor pump 10, digital controller 80 counts the pulses via pulser 160 emanating from the flow-meter 140 and displays the pulse count in real-time on the screen of fuel dispensing device display 170.

Also displayed in real-time is the flow-rate and pressure drop across the hanging hardware. The pressure drop is the vacuum difference between that pump/hose combination's nozzle transducer 100 and built-in transducer 120. When the simulated volume reaches 7.48 gallons, the digital controller takes the pulse count from the flow-meter and calculates and provides the A/L ratio on display 170. If the A/L ratio is too high or too low, display 170 would then provide a list of possible problems that the technician should investigate. Moreover, during this test it will be immediately evident to the technician whether the hanging hardware has a blocked vapor line 20, is experiencing an excessive pressure drop, or is experiencing a flow-rate outside the tolerable limits. This data is logged within digital controller 80 for later off-line analysis.

Option two (2) of the internal A/L test entails using the vacuum method. The technician performs the test in the same manner as in option one (1) described above. This time, however, the digital controller measures the vacuum pressure at built-in transducer 120 and displays same. When the simulated volume reaches 3 gallons, digital controller 80 takes the vacuum pressure reading of built-in transducer 120 and calculates and displays the A/L ratio.

Regardless of which option is chosen the goal is the same, namely, to provide a test capable of calculating the A/L ratio for a particular pump/hose combination. The external A/L test is identical to the internal A/L test with the exception that this time an external rather than built-in test tee is utilized.

The pressure drop test is a stand-alone version of the pressure drop test performed during the internal A/L test. This test is performed on each pump/hose combination on a fuel dispensing device and entails measuring the vacuum pressure difference between each pump/hose nozzle transducer 100 and built-in transducer 120. The results for each pump/hose combination are displayed and logged in the memory of the digital controller 80, This test is normally run for the general purpose of troubleshooting hanging hardware.

The pressure decay test is used to indicate whether the hanging hardware is experiencing a vapor leak. The technician first plugs the vent holes of nozzle spout 50 for the pump/hose combination being tested. These holes in nozzle spout 50 are part of the vapor recovery system and are used by the vapor recovery system to pass air from an automobile's gas tank into the vapor recovery system's vapor lines during a fill-up. After plugging the holes, the technician activates vapor pump 10 which in turn activates vapor valve 30. A vacuum will be created shutting off vapor valve 30. Nozzle transducer 100 then takes an initial vacuum pressure reading. After a specified period of time, nozzle transducer 100 takes a final vacuum pressure reading. Any variation between the two readings would indicate a vapor leak. The greater the variation the more significant the vapor leak. The results are displayed and logged within the memory of the digital controller 80. This is also a hanging hardware troubleshooting type test.

The deadhead vacuum and vapor valve test is performed to ensure complete operation of vapor valve 30 within the vapor recovery system. The technician initially checks for valve closure by (1) running vapor pump 10 and measuring the deadhead vacuum pressure via vapor line transducer 110, (2) then opening the vapor valve 30 and taking a second vapor line transducer 110 pressure reading, and (3) finally closing the vapor valve 30 and taking a third vapor line transducer 110 pressure reading. The three (3) pressure readings indicate whether vapor valve 30 is mechanically operating. For instance, if the three readings went high-low-high, then vapor valve 30 would be operating properly. However, if the three readings went high-high-high, this would indicate a vapor valve stuck in the closed position or a mis-connected vapor valve 30. Lastly, if the three readings went low-low-low, then vapor valve 30 could be stuck in the open position, or there may be a vapor line leak, or the vapor pump 10 blades may be worn. This test is similarly repeated for each pump/hose combination of a fuel dispensing device. This test is for troubleshooting the vapor valves and vapor pump.

FIG. 1 schematically illustrates a fuel dispensing device having three (3) pumps. The use of a three pump fuel dispensing system is for illustrative purposes only and in no way operates is intended to limit the applicability of the present invention. For instance, the vapor recovery diagnostic hardware described herein is equally applicable to a single pump dispenser or a dual-sided multiple pump dispenser apparatus.

It will be understood that various details of the invention may be changed without departing from the scope of the invention. Furthermore, the foregoing description is for the purpose of illustration only, and not for the purpose of limitation-the invention being defined by the claims.

What is claimed is:

1. A vapor recovery diagnostic monitoring system within a single pump or multi-pump fuel dispensing apparatus having a vapor recovery system comprising one or more vapor pumps, motor drivers, vapor valves, and vapor lines for receiving and transporting vapors to an underground storage tank, said fuel dispensing apparatus further including at least one pump and hose combination terminating in a nozzle assembly adapted to fit into an automobile gas tank, said vapor recovery diagnostic monitoring system comprising:

(a) a plurality of sensor devices situated variously throughout said vapor lines for sensing and measuring various environmental conditions relating to the operation of the vapor recovery system;

(b) a processing device coupled to each of said sensor devices for receiving and processing sensed data; and (c) memory means within said processing device for storing a baseline profile of operating parameters of the vapor recovery system elements for each pump and hose combination of the fuel dispensing apparatus, (d) the baseline profile determined by running a set of tests relating to various elements of a vapor recovery system, the set of tests including at least three of the group of tests consisting of:

a. a first test comprising dispensing fuel from a pump and recording the rate of flow for said pump within said memory means;

b. a second test comprising sending a sensor device a predetermined signal to which a predetermined signal is to be returned in order to ensure said sensor device is properly operating;

c. a third test comprising running a vapor pump associated with selected hanging hardware and recording the pressure drop across said hanging hardware with said memory means; and d. a fourth test comprising:

i. activating a vapor pump to determine a volume of air per gallon of fuel being dispensed;

ii. calibrating a vapor pump speed in order to achieve a predetermined air to liquid (A/L) ratio for the vapor pump; and iii. recording the vapor pump speed necessary to achieve the predetermined A/L ratio, wherein said sensed data is compared to the baseline profile of operating parameters in order to determine whether the vapor recovery system is operating outside of acceptable limits.

2. The system of claim 1 wherein the pump speed is calibrated to achieve pre-determined A/L ratios at discrete intervals over a plurality of fuel dispensing rates ranging between a lower fuel dispensing rate limit and an upper fuel dispensing rate limit.

3. The system of claim 2 wherein the discrete intervals between the lower fuel dispensing rate limit and an upper fuel dispensing rate limit are manually set.

4. The system of claim 2 wherein the discrete intervals between the lower fuel dispensing rate limit and an upper fuel dispensing rate limit are automatically set by said processing device.

5. The system of claim 1 wherein the pre-determined A/L ratio is 1.1.

6. The system of claim 1 wherein the pre-determined A/L ratio is 1.0.

7. The system of claim 1 operating in an automatic diagnostic mode wherein said sensor devices are continuously running including during periods of consumer use of a fuel dispensing device.

8. The system of claim 7 wherein said automatic diagnostic mode monitors for fuel flow-rates outside defined operating parameters by logging the actual flow-rate of each consumer transaction and comparing same to the baseline profile flow-rate for that particular vapor pump and hose combination to ensure the actual flow-rate is within a tolerable range for flow-rates set during installation of the fuel dispensing apparatus.

9. The system of claim 7 wherein said automatic diagnostic mode monitors for the presence of fuel in the vapor line by detecting sudden pressure rises via said sensor devices and upon such detection said processing device cycles said vapor pump in order to clear any fuel from the vapor line prior to the next consumer transaction.

10. The system of claim 7 wherein said automatic diagnostic mode monitors for a kinked, blocked, or replaced hose by detecting, via said sensor devices, a pressure increase on back-to-back consumer transactions and comparing said pressure increases to recent transaction pressure increases.

11. The system of claim 7 wherein upon detection of unsatisfactory pressure readings the processing device shuts down said vapor pump.

12. The system of claim 7 wherein said automatic diagnostic mode monitors a deadhead vacuum pressure by monitoring the vacuum reading of the vapor line transducer during a normal consumer transaction and displaying an error message at the vapor pump to alert of a possible defective vapor pump or blockage proximate to the vapor pump when said vacuum reading of a vapor line transducer is outside tolerable limits.

13. The system of claim 7 wherein said automatic diagnostic mode monitors the various sensor devices to ensure each is operating properly by periodically sending each sensor device a pre-determined signal to which a predetermined acknowledgment signal is to be returned to said processing device.

14. The system of claim 7 wherein said automatic diagnostic mode monitors for unusual pressure drops across the vapor valve by comparing the difference between pressure readings as measured by sensor devices on either side of the vapor valve.

15. The system of claim 14 wherein said difference between pressure readings as measured by sensor devices on either side of the vapor valve is stored within the processing device's memory means.

16. The system of claim 7 further comprising display means coupled to said processing device for displaying the results of said automatic diagnostic tests.

17. The system of claim 7 further comprising printing means coupled to said processing device for printing the results of said automatic diagnostic test.

18. A vapor recovery diagnostic monitoring system within a single pump or multi-pump fuel dispensing apparatus having a vapor recovery system comprising one or more vapor pumps, motor drivers, vapor valves, and a vapor lines for receiving and transporting vapors to an underground storage tank, said fuel dispensing apparatus further including at least one pump and hose combination terminating in a nozzle assembly adapted to fit into an automobile gas tank, said vapor recovery diagnostic monitoring system comprising:

a) a plurality of sensor devices situated variously throughout said vapor lines for sensing and measuring various environmental conditions relating to the operation of the vapor recovery system;

b) a processing device coupled to each of said sensor devices for receiving and processing sensed data and operating in an automatic diagnostics mode to monitor for fuel in the vapor line by detecting sudden pressure rinses via said sensor devices and upon such detection, cycling said vapor pump in order to clear fuel from the vapor line; and c) memory means within said processing device for storing a baseline profile of operating parameters of the vapor recovery system elements for each pump and hose combination of the fuel dispensing apparatus, wherein said sensed data is compared to the baseline profile of operating parameters in order to determine whether the vapor recovery system is operating outside of acceptable limits and a technician is required to assess and re-calibrate the vapor pump by running the vapor pump and recording a pressure drop across the hose in said processing device's memory means prior to placing said pump back on-line.

19. The system of claim 1 operating in a manual diagnostic mode wherein a system technician performs specific manual diagnostic tests on the vapor recovery system.

20. The system of claim 19 wherein one of said manual diagnostic tests comprises measuring the pressure difference between a pump's nozzle transducer and a built-in transducer.

21. The system of claim 20 wherein said pressure difference between the pump's nozzle transducer and the built-in transducer is recorded into the processing device memory means.

22. The system of claim 19 wherein said commissioning tests and said manual diagnostic tests are selectable and executable via a menu driven display coupled to said processing device.

23. The system of claim 19 further comprising display means coupled to said processing device for displaying the results of said commissioning and manual diagnostic tests.

24. The system of claim 19 further comprising printing means coupled to said processing device for printing the results of said commissioning and manual diagnostic tests.

25. A vapor recovery diagnostic monitoring system within a single pump or multi-pump fuel dispensing apparatus having a vapor recovery system comprising one or more vapor pumps, motor drivers, vapor valves, and vapor lines for receiving and transporting vapors to an underground storage tank, said fuel dispensing apparatus further including at least one pump and hose combination terminating in a nozzle assembly adapted to fit into an automobile gas tank, said vapor recovery diagnostic monitoring system comprising:

a plurality of sensor devices situated variously throughout said vapor lines for sensing and measuring various environmental conditions relating to the operation of the vapor recovery system;

a processing device coupled to each of said sensor devices for receiving and processing sensed data; and memory means within said processing device for storing a baseline profile of operating parameters of the vapor recovery system elements for each pump and hose combination of the fuel dispensing apparatus, wherein said sensed data is compared to the baseline profile of operating parameters in order to determine whether the vapor recovery system is operating outside of acceptable limits and when operating in a manual diagnostics mode a manual diagnostic test comprises:

(a) taking a pressure reading for a particular vapor pump and hose combination via one of said sensor devices;

(b) activating the vapor pump for the specified vapor pump and hose combination for a short period of time to flush any fuel slugs out of the vapor line;

(c) taking a second pressure reading via said one of said sensor devices and comparing to the previous pressure reading; and (d) repeatedly activating the vapor pump for a short period followed by taking pressure readings until the pressure reading after each period of the vapor pump activation reaches a steady state value.

26. A vapor recovery diagnostic monitoring system within a single pump or multi-pump fuel dispensing apparatus having a vapor recovery system comprising one or more vapor pumps, motor drivers, vapor valves, and vapor lines for receiving and transporting vapors to an underground storage tank, said fuel dispensing apparatus further including at least one pump and hose combination terminating in a nozzle assembly adapted to fit into an automobile gas tank, said vapor recovery diagnostic monitoring system comprising:

a plurality of sensor devices situated variously throughout said vapor lines for sensing and measuring various environmental conditions relating to the operation of the vapor recovery system;

a processing device coupled to each of said sensor devices for receiving and processing sensed data; and memory means within said processing device for storing a baseline profile of operating parameters of the vapor recovery system elements for each pump and hose combination of the fuel dispensing apparatus, wherein said sensed data is compared to the baseline profile of operating parameters in order to determine whether the vapor recovery system is operating outside diagnostic test comprises:

(a) plugging the ventilation holes on a nozzle spout for a particular vapor pump;

(b) activating the vapor pump which creates a vacuum sufficient to close the vapor valve;

(c) taking an initial pressure reading from a nozzle transducer;

(d) waiting a specified period of time then taking a final pressure reading from the nozzle transducer; and (e) comparing the two pressure readings whereby a difference in pressure readings indicates a vapor leak.

27. A vapor recovery diagnostic monitoring system within a single pump or multi-pump fuel dispensing apparatus having a vapor recovery system comprising one or more vapor pumps, motor drivers, vapor valves and vapor lines for receiving and transporting vapors to an underground storage tank, said fuel dispensing apparatus further including at least one pump and hose combination terminating in a nozzle assembly adapted to fit into an automobile gas tank, said vapor recovery diagnostic monitoring system comprising:

a plurality of sensor devices situated variously throughout said vapor lines for sensing and measuring various environmental conditions relating to the operation of the vapor recovery system;

a processing device coupled to each of said sensor devices for receiving aid processing sensed data; and memory means within said processing device for storing a baseline profile of operating parameters of the vapor recovery system elements for each pump and hose combination of the fuel dispensing apparatus, wherein said sensed data is compared to the baseline profile of operating parameters in order to determine whether the vapor recovery system is operating outside of acceptable limits and when operating in a manual diagnostics mode a manual diagnostic test comprises:

(a) initially checking for vapor valve closure by running the vapor pump and measuring the vacuum pressure via a vapor line transducer;

(b) opening said vapor valve and taking a second measurement of the vacuum pressure via the vapor line transducer; and (c) closing the vapor valve and taking a third measurement of the vacuum pressure via the vapor line transducer, wherein the three vapor line transducer measurements are compared in order to determine whether the vapor valve is functioning properly.

* * * * *